US011255492B2

(12) United States Patent
Hu et al.

(10) Patent No.: US 11,255,492 B2
(45) Date of Patent: Feb. 22, 2022

(54) HEAT DISSIPATION STRUCTURE FOR LAMP AND LED LAMP

(71) Applicant: OPPLE LIGHTING CO., LTD., Shanghai (CN)

(72) Inventors: Chuan Hu, Shanghai (CN); Yinfei Yu, Shanghai (CN); Wangbosheng Wu, Shanghai (CN)

(73) Assignee: Opple Lighting Co., Ltd., Shanghai (CN)

( * ) Notice: Subject to any disclaimer, the term of this patent is extended or adjusted under 35 U.S.C. 154(b) by 0 days.

(21) Appl. No.: 17/130,524

(22) Filed: Dec. 22, 2020

(65) Prior Publication Data

US 2021/0190275 A1 Jun. 24, 2021

(30) Foreign Application Priority Data

Dec. 24, 2019 (CN) ..... 201922348613.5

(51) Int. Cl.

| | |
|---|---|
| ***F21K 9/238*** | (2016.01) |
| ***F21K 9/90*** | (2016.01) |
| ***F21V 29/77*** | (2015.01) |
| ***F21Y 115/10*** | (2016.01) |

(52) U.S. Cl.

CPC ..... *F21K 9/238* (2016.08); *F21K 9/90* (2013.01); *F21V 29/77* (2015.01); *F21Y 2115/10* (2016.08)

(58) Field of Classification Search

None

See application file for complete search history.

(56) References Cited

U.S. PATENT DOCUMENTS

2021/0190275 A1* 6/2021 Hu ..... F21V 29/77
2021/0289718 A1* 9/2021 Zhang ..... A01G 9/20

FOREIGN PATENT DOCUMENTS

CN 204141359 U * 2/2015
CN 206918689 U * 1/2018 ..... F21K 9/232

* cited by examiner

*Primary Examiner* — Britt D Hanley
(74) *Attorney, Agent, or Firm* — Arch & Lake LLP

(57) ABSTRACT

Examples of the disclosure disclose a heat dissipation structure for a lamp, which includes: a base cup, a supporting top cover, a base cup heat dissipation housing, and a top cover heat dissipation housing. The base cup and the supporting top cover are both made of metal, the supporting top cover is detachably connected to the base cup by interference fitting; and the base cup heat dissipation housing and the top cover heat dissipation housing are both made of thermally conductive plastic. In the present disclosure, the supporting top cover and the base cup are connected to each other by interference fitting to form an internal heat conduction structure; the heat is transferred to the outside by the top cover heat dissipation housing corresponding to the supporting top cover and the base cup corresponding to the base cup.

19 Claims, 2 Drawing Sheets

HEAT DISSIPATION STRUCTURE FOR LAMP AND LED LAMP

CROSS-REFERENCE TO RELATED APPLICATIONS

This application is based upon and claims the priority of Chinese Patent Application No. 201922348613.5 filed on Dec. 24, 2019, the entire content of which is hereby incorporated by reference herein for all purposes.

TECHNICAL FIELD

The disclosure relates to the technical field of lighting equipment, in particular to a heat dissipation structure for a lamp and an LED lamp.

BACKGROUND

LED lamps are popular with consumers for their low power consumption and controllable light color, and are widely used in both indoor and outdoor decoration. In order to reduce the manufacturing cost, the lamp body of LED lamps are often made of plastic-metal composite materials.

SUMMARY

The present disclosure provides a heat dissipation structure for a lamp, an LED lamp and a method of manufacturing a heat dissipation structure for a lamp.

The present disclosure provides a heat dissipation structure for a lamp. The heat dissipation structure may include a base cup, a supporting top cover, a base cup heat dissipation housing, and a top cover heat dissipation housing.

The base cup and the supporting top cover may be both made of metal, the base cup may be provided with a rim, the supporting top cover may be provided with a fastening part corresponding to the rim, and the supporting top cover may be detachably connected to the base cup by interference fitting between the fastening part and the rim.

The base cup heat dissipation housing and the top cover heat dissipation housing may be both made of thermally conductive plastic, the base cup may include a first outer peripheral surface, the base cup heat dissipation housing may cover the first outer peripheral surface and may attach to the first outer peripheral surface; the support top cover may include a second outer peripheral surface, and the top cover heat dissipation housing may cover the second outer peripheral surface and may adhere to the second outer peripheral surface.

The present disclosure provides a light-emitting diode (LED) lamp. The LED lamp may include a driving module, an LED light source, and a heat dissipation structure for the lamp, and the heat dissipation structure for the lamp may include a base cup, a supporting top cover, a base cup heat dissipation housing, and a top cover heat dissipation housing.

The base cup and the supporting top cover may be both made of metal, the base cup may be provided with a rim, the supporting top cover may be provided with a fastening part corresponding to the rim, and the supporting top cover may be detachably connected to the base cup by interference fitting between the fastening part and the rim.

The base cup heat dissipation housing and the top cover heat dissipation housing may be both made of thermally conductive plastic, the base cup may include a first outer peripheral surface, the base cup heat dissipation housing may cover the first outer peripheral surface and may attach to the first outer peripheral surface; the support top cover may include a second outer peripheral surface, and the top cover heat dissipation housing may cover the second outer peripheral surface and may adhere to the second outer peripheral surface.

The driving module may be electrically connected to the LED light source, and the driving module may be arranged inside the base cup.

It is to be understood that both the foregoing general description and the following detailed description are exemplary and explanatory only and are not restrictive of the present disclosure.

BRIEF DESCRIPTION OF THE DRAWINGS

The drawings described here are used to provide a further understanding of the present disclosure and constitute a part of the present disclosure. The examples and descriptions of the present disclosure are used to explain the present disclosure, and do not constitute an improper limitation of the present disclosure. In the drawings.

DETAILED DESCRIPTION

The technical solutions of the present disclosure are described with reference to examples and corresponding drawings of the present disclosure. The described examples are only part but not all of the examples of the present disclosure. Based on the examples in the present disclosure, all other examples obtained by those ordinary skilled in the art without any inventive work belong to the protection scope of the present disclosure.

The terminology used in the present disclosure is for the purpose of describing exemplary examples only and is not intended to limit the present disclosure. As used in the present disclosure and the appended claims, the singular forms "a," "an" and "the" are intended to include the plural forms as well, unless the context clearly indicates otherwise. It shall also be understood that the terms "or" and "and/or" used herein are intended to signify and include any or all possible combinations of one or more of the associated listed items, unless the context clearly indicates otherwise.

It shall be understood that, although the terms "first," "second," "third," and the like may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

The description of numerals used in this disclosure may include:

1—base cup, 2—supporting top cover, 3—base cup heat dissipation housing, 4—top cover heat dissipation housing, 5—fixing claw, 6—driving module, 7—LED light source, 8—lampshade, 10—rim, 12—first outer peripheral surface,

20—fastening part, 22—second outer peripheral surface, 24—protruding part, 30—first heat dissipation outer peripheral surface, 32—first heat dissipation fin, 40—second heat dissipation outer peripheral surface, 42—second heat dissipation fin, 44—light propagation channel, 50—fixing part, 52—claw part, 240—top end, 242—base, 244—cooperated-connecting element, 500—connection element, a—first direction.

Sometimes, the lamp body of LED lamps are often made of plastic-metal composite materials, and to facilitate manufacture and the assembly of a metal inner shell and a plastic outer shell, a plastic-metal composite lamp body is often small, which leads to a small heat dissipation area, thus reducing the heat dissipation efficiency.

Figure 1:
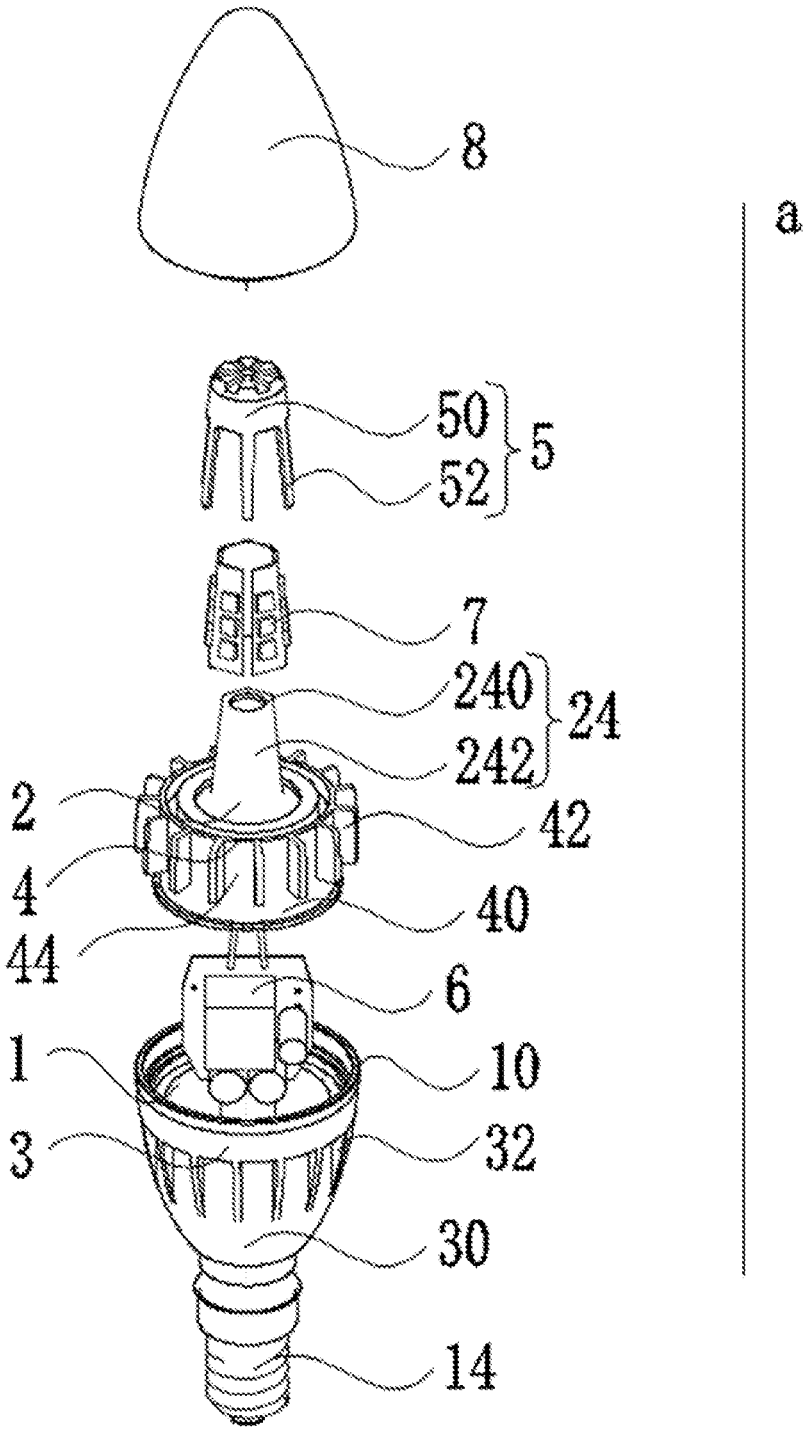
FIG. 1 is a schematic diagram of each component of an LED lamp disclosed in an example of the disclosure.
Figure 3:
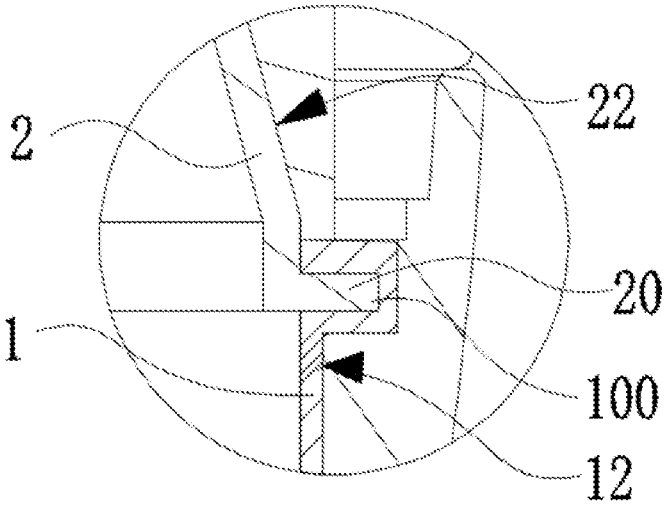
FIG. 3 is a schematically enlarged diagram of area A in FIG. 2.

The disclosure provides a heat dissipation structure for a lamp; a base cup 1 and a supporting top cover 2 are both made of metal. The base cup 1 and the supporting top cover 2 are either made of the same metal or made of different metals. For example, the base cup 1 is made of aluminum alloy, and the support top cover 2 is made of copper alloy. To achieve a good heat conduction effect between the base cup 1 and the supporting top cover 2, in this example, as illustrated in FIG. 1, the base cup 1 is provided with an upward rim 10; on the one hand, the rim 10 facilitates the installation of components such as a driving module or a power supply into the base cup 1, and on the other hand, the rim is used for matching with a corresponding fastening part 20 on the supporting top cover 2. In this example, as illustrated in FIG. 3, an inner periphery of the rim 10 is provided with a fastening groove 100 corresponding to the fastening part 20. Correspondingly, the fastening part 20 is a fastening ring. The dimension of the fastening ring is slightly larger than the dimension of the fastening groove 100. In this way, when the fastening ring extends into the fastening groove 100 by elastic deformation, interference fitting is realized, so that the fastening ring tightly attached to an inner wall of the fastening groove 100, which allows the heat of the base cup 1 to be transferred to the supporting top cover 2, and vice versa, thus making the base cup 1 and the supporting top cover 2 form a complete heat conductor.

In order to ensure the heat dissipation efficiency on the premise that the manufacturing cost is reduced, in this example, a base cup heat dissipation housing 3 and a top cover heat dissipation housing 4 are made of thermally conductive plastic, which may be graphite-filled PC plastic, or metal powder-filled PPS plastic, etc., as long as the thermally conductive plastic has high thermal conductivity. As illustrated in FIG. 3, the base cup 1 has a first outer peripheral surface 12, the base cup heat dissipation housing 3 covers and attaches to the first outer peripheral surface 12; the supporting top cover 2 has a second outer peripheral surface 22, and the top cover heat dissipation housing 4 covers and attaches to the second outer peripheral surface 22, so that the heat of the base cup 1 can be transferred to the base cup heat dissipation housing 3 by the first outer peripheral surface 12 and the heat of the supporting top cover 2 can be transferred to the top cover heat dissipation housing 4 by the second outer peripheral surface 22.

Because both the base cup heat dissipation housing 3 and the top cover heat dissipation housing 4 are made of thermally conductive plastic, they can be easily molded and shaped, so that a heat dissipation fin structure illustrated in FIG. 1 or other complicated heat dissipation structures, such as a corrugated structure, can be arranged thereon, thereby further increasing the heat dissipation efficiency.

In the present disclosure, the supporting top cover 2 and the base cup 1 are connected by interference fitting to form an internal heat conduction structure, and the heat is transferred to the outside by the top cover heat dissipation housing 4 which corresponds to the supporting top cover 2 and the base cup heat dissipation housing 3 which corresponds to the base cup 1. By jointing two groups of components to form an entire lamp body and each group of components is smaller than the entire lamp body, the heat dissipation area is increased while low manufacture and assembly difficulty is ensured, thereby realizing the technical effect of increasing the heat dissipation efficiency.

As illustrated in FIG. 1, the base cup heat dissipation housing 3 has a first heat dissipation outer peripheral surface 30 facing away from the base cup 1. First heat dissipation fins 32 extending in a direction away from the base cup 1 are arranged on the first heat dissipation outer peripheral surface 30. The first heat dissipation fins 32 may be arranged radially and uniformly along a circumferential direction of the first heat dissipation outer peripheral surface 30 as illustrated in FIG. 1, or may be arranged in a circumferential direction and in parallel with one direction, as long as the heat dissipation area can be increased. As illustrated in FIG. 1, the base cup 1 and the supporting top cover 2 are arranged along the first direction a, and the first heat dissipation fins 32 extend along the first direction a; because the lamp which adopts the heat dissipation structure illustrated in this example is vertically used in most cases, it is readily for the flow of hot air and the heat dissipation efficiency is increased.

As illustrated in FIG. 1, similar to the base cup heat dissipation housing 3, the top cover heat dissipation housing 4 has a second heat dissipation outer peripheral surface 40 facing away from the supporting top cover 2, and second heat dissipation fins 42 extending in a direction away from the supporting top cover 2 are arranged on the second heat dissipation outer peripheral surface 40. The second heat dissipation fins 42 may be arranged radially and uniformly along a circumferential direction of the second heat dissipation outer peripheral surface 40 as illustrated in FIG. 1, or may be arranged in a circumferential direction and in parallel with one direction, as long as the heat dissipation area can be increased. As illustrated in FIG. 1, the second heat dissipation fins 42 also extend along the first direction a; because the lamp which adopts the heat dissipation structure illustrated in this example is vertically used in most cases, it is readily for the flow of hot air and the heat dissipation efficiency is increased.

In an LED bulb, the main heating source includes an LED light source in addition to the driving module and other structures arranged inside the lamp body. In order to increase the heat dissipation efficiency and ensure the light output ratio, in this example, the supporting top cover 2 is provided with a protruding part 24 for supporting the LED light source. As illustrated in FIG. 1, in this example of the disclosure, in order to match the LED light source arranged in a form of a strip-shaped light source plate, the protruding part 24 is designed in a prismatic shape, and other shapes like a cylindrical shape can also be adopted to match the LED light source in other shapes, which will not be described in detail here, as long as it can support the LED light source and transfer the heat generated from the LED light source to the supporting top cover 2.

Figure 2:
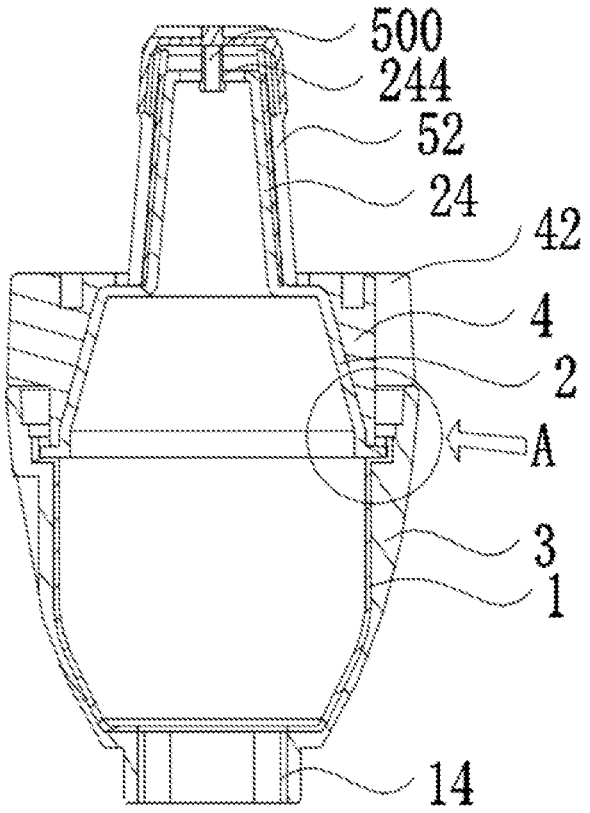
FIG. 2 is a schematically cross-sectional view of a heat dissipation structure for a lamp disclosed in an example of the disclosure.

As illustrated in FIG. 2, the protruding part 24 is integrated with the supporting top cover 2, which facilitates heat transfer, and therefore the material of the protruding part 24 is the same as that of the supporting top cover 2. Alternatively, the protruding part 24 is fixed to the supporting top cover 2 by interference fitting, as long as heat can be transferred.

In order to fix the LED light source on the protruding part 24, as illustrated in FIG. 1, a fixing claw 5 is further provided for cooperating with the protruding part 24, thereby fixing the LED light source. The fixing claw 5 is provided with a fixing part 50 and a claw part 52, the protruding part 24 is provided with a top end 240 and a base 242, and the top end 240 is connected to the supporting top cover 2 by the base 242. In order to fix the fixing claw 5 on the protruding part 24, the fixing part 50 includes a connecting element 500, and the top end 240 includes a cooperated-connecting element 244. As illustrated in FIG. 2, the connecting element 500 is a tenon, and the cooperated-connecting element 244 is a fixing hole. The tenon is inserted into the fixing hole by elastic deformation, and therefore the connecting element 500 is fixedly connected with the cooperated-connecting element 244. The connecting element 500 and the cooperated-connecting element 244 may also be a nut and a screw respectively or other structures.

When the connecting element 500 is detachably connected to the cooperated-connecting element 244, the claw part 52 extends in a direction opposite to a protruding direction of the protruding part 24 and is close to the base 240, in this way, in a situation that an LED light source plate or LED light source belt is attached to the base 240, the claw part 52 can cooperate with the base 240 to clamp the LED light source, thus improving its stability.

An example of the disclosure further provides an LED lamp as illustrated in FIG. 1; the LED lamp comprises the above-mentioned heat dissipation structure, a driving module 6, and an LED light source 7; the driving module 6 is electrically connected to the LED light source 7 and drives the LED light source 7 to emit light. The LED light source 7 as illustrated in FIG. 1 is arranged in a form of a light source plate and attached to the protruding part 24. In a situation that no structure like the protruding part 24 is provided in the lamp, the LED light source may also be attached to a side of the supporting top cover 2 away from the base cup 1. The driving module 6 is arranged inside the base cup 1, and the heat generated from the driving module 6 is transferred, through the base cup 1, to the base cup heat dissipation housing 3, the supporting top cover 2, and the top cover heat dissipation housing 4, and further transferred to the outside.

In order to enhance the light emitting effect, as illustrated in FIG. 1, a lampshade 8 is further provided. The lampshade 8 illustrated in FIG. 1 is connected to the supporting top cover 2 and covers the LED light source 7; alternatively, the lampshade 8 may be connected to other parts, such as the base cup heat dissipation housing 3.

As illustrated in FIG. 1, when the LED light source 7 is arranged on the side of the supporting top cover 2 away from the base cup 1, the plurality of second heat dissipation fins 42 are arranged along a circumferential direction of the top cover heat dissipation housing 4 and extend along the first direction a. Light propagation channels 44 along the first direction a are formed between adjacent second heat dissipation fins 42. In this way, the light emitted from the LED light source 7 can not only illuminate the side of the supporting top cover 2 away from the base cup 1, but also illuminate the opposite side by the light propagation channels 44, thus improving the light transmittance ratio.

As illustrated in FIG. 1, the bottom of the base cup 1 is further provided with a lamp cap 14 for connecting with a power supply base. The lamp cap 14 illustrated in FIG. 1 is a threaded lamp cap, but the lamp cap may also be in other shapes such as a plug according to the specific model of the power supply base, which will not be described in detail here. The lamp cap 14 is used for electrically connecting with the driving module 6 and transmitting external power to the driving module 6.

According to the disclosure, the supporting top cover 2 and the base cup 1 are connected with each other by interference fitting to form the internal heat conduction structure, and the heat is transferred to the outside by the top cover heat dissipation housing 4 which corresponds to the supporting top cover 2 and the base cup heat dissipation housing 3 which corresponds to the base cup 1. By jointing two groups of components to form an entire lamp body and each group of components is smaller than the entire lamp body, the heat dissipation area is increased while low manufacture and assembly difficulty is ensured, thereby realizing the technical effect of increasing the heat dissipation efficiency.

The present disclosure provides a heat dissipation structure for a lamp and an LED lamp.

The examples of the present disclosure provide a heat dissipation structure for a lamp, which comprises: a base cup, a supporting top cover, a base cup heat dissipation housing, and a top cover heat dissipation housing, the base cup and the supporting top cover are both made of metal, the base cup is provided with a rim, the supporting top cover is provided with a fastening part corresponding to the rim, and the supporting top cover is detachably connected to the base cup by interference fitting between the fastening part and the rim; and the base cup heat dissipation housing and the top cover heat dissipation housing are both made of thermally conductive plastic, the base cup has a first outer peripheral surface, the base cup heat dissipation housing covers and attaches to the first outer peripheral surface, the support top cover has a second outer peripheral surface, and the top cover heat dissipation housing covers and attaches to the second outer peripheral surface.

Preferably, the base cup heat dissipation housing is provided with first heat dissipation fins and a first heat dissipation outer peripheral surface, and the first heat dissipation fins are connected to the first heat dissipation outer peripheral surface and extend in a direction away from the base cup.

Preferably, the first heat dissipation fins extend along an orientation direction of the rim.

Preferably, an inner periphery of the rim is provided with a fastening groove corresponding to the fastening part, the fastening part is a fastening ring, and the supporting top cover and the base cup are detachably connected to each other by interference fastening connection between the fastening ring and the fastening groove.

Preferably, the top cover heat dissipation housing is provided with second heat dissipation fins and a second heat dissipation outer peripheral surface, and the second heat dissipation fins are connected to the second heat dissipation outer peripheral surface and extend along a direction away from the supporting top cover.

Preferably, the second heat dissipation fins extend along an orientation direction of the rim.

Preferably, the supporting top cover is provided with a protruding part for supporting an LED light source, and the protruding part is connected to the supporting top cover and protrudes along a direction away from the base cup.

Preferably, the heat dissipation structure for the lamp further comprises a fixing claw configured for fixing the LED light source, the fixing claw is provided with a fixing part and a claw part; the protruding part is provided with a top end and a base, the top end is connected to the supporting top cover by the base, and the fixing part is provided with a connecting element; and the top end is provided with a cooperated-connecting element, the fixing claw is detachably connected to the protruding part by cooperation connection between the connecting element and the cooperated-connecting element, and the claw part extends along a direction opposite to an protruding direction of the protruding part and is close to the base.

The examples of the present disclosure further provide a LED lamp, which comprises: a driving module, an LED light source, and the heat dissipation structure for the lamp according to any one of claims 1 to 8, the driving module is electrically connected to the LED light source, and the driving module is arranged inside the base cup.

Preferably, the LED lamp further comprises a lampshade, the lampshade is connected to the heat dissipation structure for the lamp and covers the LED light source.

Preferably, the LED light source is arranged on a side of the supporting top cover away from the base cup, the top cover heat dissipation housing is provided with a plurality of second heat dissipation fins and a second heat dissipation outer peripheral surface away from the supporting top cover, the plurality of the second heat dissipation fins are connected to the second heat dissipation outer peripheral surface and extend along a direction away from the supporting top cover, the second heat dissipation fins extend along an orientation direction of the rim, and light propagation channels along the orientation direction of the rim are formed between adjacent second heat dissipation fins.

In the present disclosure, the supporting top cover and the base cup are connected to each other by interference fitting, so as to form an internal heat conduction structure, moreover, the heat is transferred to the outside by the top cover heat dissipation housing corresponding to the supporting top cover and the base cup heat dissipation housing corresponding to the base cup. By jointing two groups of components to form an entire lamp body and each group of components is smaller than the entire lamp body, the heat dissipation area is increased while low manufacture and assembly difficulty is ensured, thereby realizing the technical effect of increasing the heat dissipation efficiency.

The present disclosure also provides a method of manufacturing a heat dissipation structure for a lamp. The method may include providing a base cup, a supporting top cover, a base cup heat dissipation housing, and a top cover heat dissipation housing, where the base cup and the supporting top cover are both made of metal, and the base cup heat dissipation housing and the top cover heat dissipation housing are both made of thermally conductive plastic; providing the base cup with a rim, and providing the supporting top cover with a fastening part corresponding to the rim, and detachably connecting the supporting top cover to the base cup by interference fitting between the fastening part and the rim; providing a first outer peripheral surface for the base cup, where the base cup heat dissipation housing covers the first outer peripheral surface and attaches to the first outer peripheral surface; and providing a second outer peripheral surface for the support top cover, where the top cover heat dissipation housing covers the second outer peripheral surface and adheres to the second outer peripheral surface.

The method may also include providing the base cup heat dissipation housing with first heat dissipation fins and a first heat dissipation outer peripheral surface; connecting the first heat dissipation fins to the first heat dissipation outer peripheral surface; and extending the first heat dissipation fins along a direction away from the base cup.

The method may include extending the first heat dissipation fins along an orientation direction of the rim.

The method may include providing an inner periphery of the rim with a fastening groove corresponding to the fastening part where the fastening part comprises a fastening ring; and detachably connecting the supporting top cover and the base cup to each other by interference fastening connection between the fastening ring and the fastening groove.

The method may include providing the top cover heat dissipation housing with second heat dissipation fins and a second heat dissipation outer peripheral surface; and connecting the second heat dissipation fins to the second heat dissipation outer peripheral surface and extending the second heat dissipation fins along a direction away from the supporting top cover.

The method may include extending the second heat dissipation fins along an orientation direction of the rim.

The method may include providing the supporting top cover with a protruding part for supporting an LED light source; and connecting the protruding part to the supporting top cover and protrudes along a direction away from the base cup.

The method may also include providing a fixing claw configured for fixing the LED light source; providing the fixing claw with a fixing part and a claw part; providing the protruding part with a top end and a base; connecting the top end to the supporting top cover by the base; providing the fixing part with a connecting element; providing the top end with a cooperated-connecting element; detachably connecting the fixing claw to the protruding part by cooperation connection between the connecting element and the cooperated-connecting element; and extending the claw part being close to the base along a direction opposite to a protruding direction of the protruding part.

The present disclosure may include dedicated hardware implementations such as application specific integrated circuits, programmable logic arrays and other hardware devices. The hardware implementations can be constructed to implement one or more of the methods described herein. Examples that may include the apparatus and systems of various implementations can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the system disclosed may encompass software, firmware, and hardware implementations. The terms "module," "sub-module," "circuit," "sub-circuit," "circuitry," "sub-circuitry," "unit," or "sub-unit" may include memory (shared, dedicated, or group) that stores code or instructions that can be executed by one or more processors. The module refers herein may include one or more circuit with or without stored code or instructions. The module or circuit may include one or more components that are connected.

The above examples of the present disclosure focus on the differences among various examples, and the different optimization features among the various examples can be combined to form a better example as long as they are not contradictory, which will not be detailed here for brevity concern.

The above-described are only examples of the present disclosure, and are not used to limit the present disclosure. For those skilled in the art, various modifications and variations are possible. Any modification, equivalent substitution, improvement, and others made within the spirit and principle of the present disclosure shall be included within the scope the present disclosure.

What is claimed is:

1. A heat dissipation structure for a lamp, comprising: a base cup, a supporting top cover, a base cup heat dissipation housing, and a top cover heat dissipation housing, wherein:

the base cup and the supporting top cover are both made of metal, the base cup is provided with a rim, the supporting top cover is provided with a fastening part corresponding to the rim, and the supporting top cover is detachably connected to the base cup by interference fitting between the fastening part and the rim; and the base cup heat dissipation housing and the top cover heat dissipation housing are both made of thermally conductive plastic, the base cup comprises a first outer peripheral surface, the base cup heat dissipation housing covers the first outer peripheral surface and attaches to the first outer peripheral surface; the support top cover comprises a second outer peripheral surface, and the top cover heat dissipation housing covers the second outer peripheral surface and adheres to the second outer peripheral surface.

2. The heat dissipation structure for the lamp according to claim 1, wherein the base cup heat dissipation housing is provided with first heat dissipation fins and a first heat dissipation outer peripheral surface, and the first heat dissipation fins are connected to the first heat dissipation outer peripheral surface and extend along a direction away from the base cup.

3. The heat dissipation structure for the lamp according to claim 2, wherein the first heat dissipation fins extend along an orientation direction of the rim.

4. The heat dissipation structure for the lamp according to claim 1, wherein an inner periphery of the rim is provided with a fastening groove corresponding to the fastening part, the fastening part comprises a fastening ring, and the supporting top cover and the base cup are detachably connected to each other by interference fastening connection between the fastening ring and the fastening groove.

5. The heat dissipation structure for the lamp according to claim 1, wherein the top cover heat dissipation housing is provided with second heat dissipation fins and a second heat dissipation outer peripheral surface, and the second heat dissipation fins are connected to the second heat dissipation outer peripheral surface and extend along a direction away from the supporting top cover.

6. The heat dissipation structure for the lamp according to claim 5, wherein the second heat dissipation fins extend along an orientation direction of the rim.

7. The heat dissipation structure for the lamp according to claim 1, wherein the supporting top cover is provided with a protruding part for supporting an LED light source, and the protruding part is connected to the supporting top cover and protrudes along a direction away from the base cup.

8. The heat dissipation structure for the lamp according to claim 7, further comprising a fixing claw configured for fixing the LED light source, wherein the fixing claw is provided with a fixing part and a claw part; the protruding part is provided with a top end and a base, the top end is connected to the supporting top cover by the base, and the fixing part is provided with a connecting element; and the top end is provided with a cooperated-connecting element, the fixing claw is detachably connected to the protruding part by cooperation connection between the connecting element and the cooperated-connecting element, and the claw part extends along a direction opposite to a protruding direction of the protruding part and is close to the base.

9. An LED lamp, comprising: a driving module, an LED light source, and a heat dissipation structure for the lamp, wherein the heat dissipation structure for the lamp comprises a base cup, a supporting top cover, a base cup heat dissipation housing, and a top cover heat dissipation housing, wherein:

the base cup and the supporting top cover are both made of metal, the base cup is provided with a rim, the supporting top cover is provided with a fastening part corresponding to the rim, and the supporting top cover is detachably connected to the base cup by interference fitting between the fastening part and the rim;

the base cup heat dissipation housing and the top cover heat dissipation housing are both made of thermally conductive plastic, the base cup comprises a first outer peripheral surface, the base cup heat dissipation housing covers the first outer peripheral surface and attaches to the first outer peripheral surface; the support top cover comprises a second outer peripheral surface, and the top cover heat dissipation housing covers the second outer peripheral surface and adheres to the second outer peripheral surface; and the driving module is electrically connected to the LED light source, and the driving module is arranged inside the base cup.

10. The LED lamp according to claim 9, further comprising a lampshade, wherein the lampshade is connected to the heat dissipation structure for the lamp and covers the LED light source.

11. The LED lamp according to claim 9, wherein the LED light source is arranged on a side of the supporting top cover away from the base cup, the top cover heat dissipation housing is provided with a plurality of second heat dissipation fins and a second heat dissipation outer peripheral surface away from the supporting top cover, the plurality of the second heat dissipation fins are connected to the second heat dissipation outer peripheral surface and extend along a direction away from the supporting top cover, the second heat dissipation fins extend along an orientation direction of the rim, and light propagation channels along the orientation direction of the rim are formed between adjacent second heat dissipation fins.

12. A method of manufacturing a heat dissipation structure for a lamp, comprising:

providing a base cup, a supporting top cover, a base cup heat dissipation housing, and a top cover heat dissipation housing, wherein the base cup and the supporting top cover are both made of metal, and the base cup heat dissipation housing and the top cover heat dissipation housing are both made of thermally conductive plastic;

providing the base cup with a rim, and providing the supporting top cover with a fastening part corresponding to the rim, and detachably connecting the supporting top cover to the base cup by interference fitting between the fastening part and the rim;

providing a first outer peripheral surface for the base cup, wherein the base cup heat dissipation housing covers the first outer peripheral surface and attaches to the first outer peripheral surface; and providing a second outer peripheral surface for the support top cover, wherein the top cover heat dissipation housing covers the second outer peripheral surface and adheres to the second outer peripheral surface.

13. The method according to claim 12, further comprising:

providing the base cup heat dissipation housing with first heat dissipation fins and a first heat dissipation outer peripheral surface; connecting the first heat dissipation fins to the first heat dissipation outer peripheral surface; and extending the first heat dissipation fins along a direction away from the base cup.

14. The method according to claim 13, further comprising extending the first heat dissipation fins along an orientation direction of the rim.

15. The method according to claim 12, further comprising:

providing an inner periphery of the rim with a fastening groove corresponding to the fastening part wherein the fastening part comprises a fastening ring; and detachably connecting the supporting top cover and the base cup to each other by interference fastening connection between the fastening ring and the fastening groove.

16. The method according to claim 12, further comprising:

providing the top cover heat dissipation housing with second heat dissipation fins and a second heat dissipation outer peripheral surface; and connecting the second heat dissipation fins to the second heat dissipation outer peripheral surface and extending the second heat dissipation fins along a direction away from the supporting top cover.

17. The method according to claim 16, further comprising:

extending the second heat dissipation fins along an orientation direction of the rim.

18. The method according to claim 12, further comprising:

providing the supporting top cover with a protruding part for supporting an LED light source; and connecting the protruding part to the supporting top cover and protrudes along a direction away from the base cup.

19. The method according to claim 18, further comprising:

providing a fixing claw configured for fixing the LED light source;

providing the fixing claw with a fixing part and a claw part;

providing the protruding part with a top end and a base;

connecting the top end to the supporting top cover by the base;

providing the fixing part with a connecting element;

providing the top end with a cooperated-connecting element;

detachably connecting the fixing claw to the protruding part by cooperation connection between the connecting element and the cooperated-connecting element; and extending the claw part being close to the base along a direction opposite to a protruding direction of the protruding part.

* * * * *